US005632165A

United States Patent [19]

Perry

[11] Patent Number: 5,632,165

[45] Date of Patent: May 27, 1997

[54] SECURITY ANCHOR FOR LAPTOP COMPUTER

[76] Inventor: Robert C. Perry, 5755 SW. Willow La., Lake Oswego, Oreg. 97035-5340

[21] Appl. No.: 533,918

[22] Filed: Sep. 26, 1995

[51] Int. Cl.[6] ..... E05B 73/00

[52] U.S. Cl. ..... 70/30; 70/58; 70/298; 70/18

[58] Field of Search ..... 70/30, 18, 58, 70/296, 297, 298, 299, 300, 287, 288, 49

[56] References Cited

U.S. PATENT DOCUMENTS

| | | | |
|---|---|---|---|
| 1,401,030 | 12/1921 | Ashkar | 70/300 |
| 3,518,853 | 7/1970 | Bolte | 70/58 |
| 3,670,535 | 6/1972 | Settrer et al. | 70/58 |
| 3,765,197 | 10/1973 | Foote | 70/49 |
| 4,196,603 | 4/1980 | Malacheski et al. | 70/299 |
| 4,524,592 | 6/1985 | Saitoh | 70/287 |
| 4,570,465 | 2/1986 | Bennett | 70/58 |
| 4,685,697 | 8/1987 | Thorley | 70/58 |
| 4,733,840 | 3/1988 | D'Amore | 70/58 |
| 4,792,073 | 12/1988 | Jacober | 70/58 |
| 5,050,836 | 9/1991 | Marous | 70/58 |
| 5,520,031 | 5/1996 | Davidge | 70/58 |

FOREIGN PATENT DOCUMENTS

| | | | |
|---|---|---|---|
| 169664 | 4/1951 | Austria | 70/298 |
| 28259 | 10/1908 | Sweden | 70/298 |

*Primary Examiner*—Darnell M. Boucher
*Attorney, Agent, or Firm*—Smith-Hill and Bedell

[57] ABSTRACT

A security anchor for securing a portable article against theft comprises a block having a first face that is in confronting and contacting relationship with the article when the block is attached thereto. The block is formed with multiple slots that enter the block at a second face and are separated by webs of the block, and with a bore that enters the block at a third face and passes through the webs. A shaft that can be inserted in the bore has a plurality of first length segments that alternate along the shaft with a plurality of second length segments such that when the shaft is in a fully inserted position in the bore, the first length segments are located in the slots respectively. The first length segments are of smaller cross-sectional area than the second length segments and are connected to the second length segments by shoulder portions of the shaft. A slider can be fitted in each of the slots. Each slider can slide in its respective slot between a first position and a second position. Each slider is formed with an aperture having a first portion that is sized to accept a first length segment of the shaft but is too small to receive a second length segment thereof and a second portion that is large enough to receive a second length segment of the shaft, whereby the sliders can be brought to respective positions such that the shaft can be inserted into and removed from the bore and in other positions of the sliders the shaft cannot be non-destructively removed from the bore.

14 Claims, 2 Drawing Sheets

SECURITY ANCHOR FOR LAPTOP COMPUTER

BACKGROUND OF THE INVENTION

This invention relates to a security anchor for a laptop computer.

Laptop computers are more versatile than other computers because they are portable. For example, they can be easily carried to conferences, on airplanes, or back and forth between work and home. The portability of laptop computers is also a hazard. Because they are small and lightweight, laptop computers are ideal targets for theft. They are expensive, popular, and easy to steal and resell.

It is not always feasible for the owner to carry his laptop computer with him. It may be necessary to leave it unattended for long or short periods of time. Even if the owner has to step away for just a few minutes, it is possible for a thief to grab the computer and disappear quickly. To protect his laptop computer from theft, the owner needs an effective, easy-to-use security anchor.

It is known to utilize security anchors employing flexible cables for protecting electronic equipment from theft. However, in such anchors, the cable is permanently attached to the equipment. Such security anchors are not practical for laptop computers because laptop computers are designed to be portable. If a security anchor consisting of a permanent cable was attached to a laptop computer, it would make transporting the laptop computer difficult and cumbersome because the cable would not fit into the laptop case but would still have to be firmly secured in a manner that would ensure that it would not drag on the ground or interfere with ease of movement.

SUMMARY OF THE INVENTION

In accordance with the invention, there is provided a security anchor for securing a portable article against theft, comprising a block for attachment to the article, the block having a first face that is in confronting and contacting relationship with the article when the block is attached thereto and also having a second face and a third face, the block being formed with multiple slots that enter the block at the second face and are separated by webs of the block, and with a bore that enters the block at the third face and passes through the webs, a shaft that can be inserted in the bore, the shaft having a plurality of first length segments that alternate along the shaft with a plurality of second length segments such that when the shaft is in a fully inserted position in the bore, the first length segments are located in the slots respectively, the first length segments being of smaller cross-sectional area than the second length segments and being connected to the second length segments by shoulder portions of the shaft, and a plurality of sliders that can be fitted in the slots respectively and each of which can slide in its respective slot between a first position and a second position, each slider being formed with an aperture having a first portion that is sized to accept a first length segment of the shaft but is too small to receive a second length segment thereof and a second portion that is large enough to receive a second length segment of the shaft, whereby the sliders can be brought to respective positions such that the shaft can be inserted into and removed from the bore and in other positions of the sliders the shaft cannot be non-destructively removed from the bore.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figure 1:
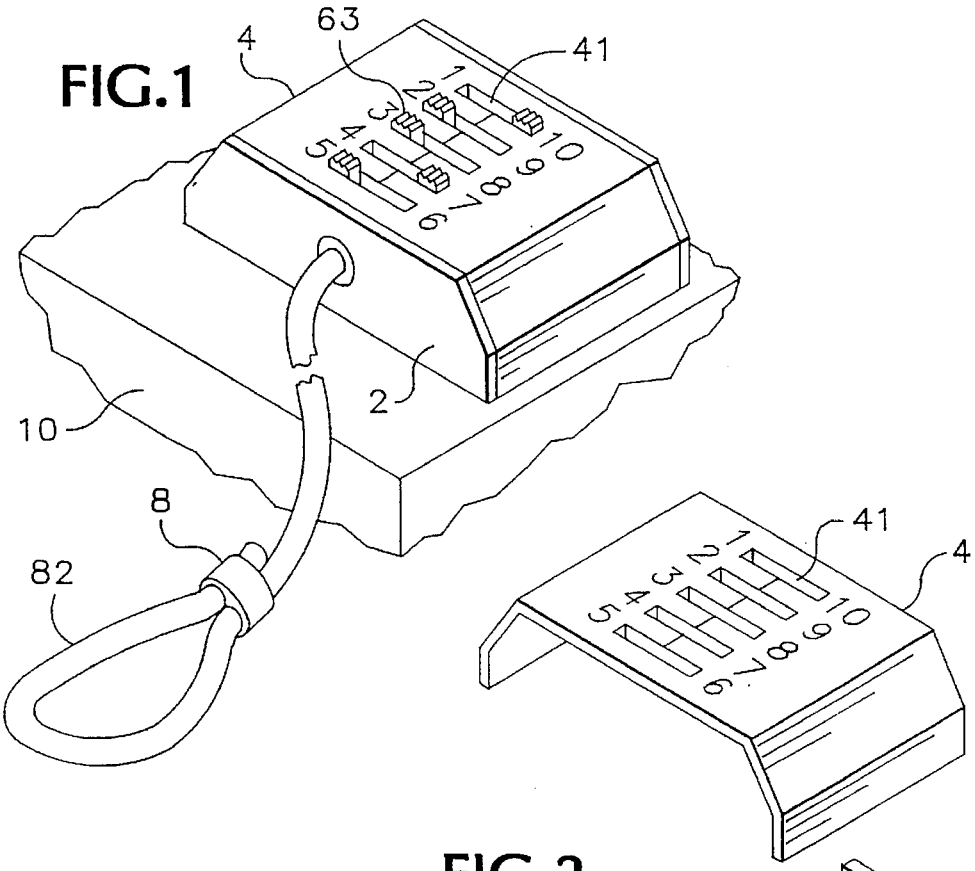
FIG. 1 is a perspective view of a security anchor embodying the present invention.

The security anchor shown in FIGS. 1–6 consists of a block 2, a cover plate 4, four regular sliders 6, one special slider 7, and a flexible security cable 8 with a shaft 81 (FIG. 2) at one end and a loop 82 (FIG. 1) at the other end.

Figure 2:
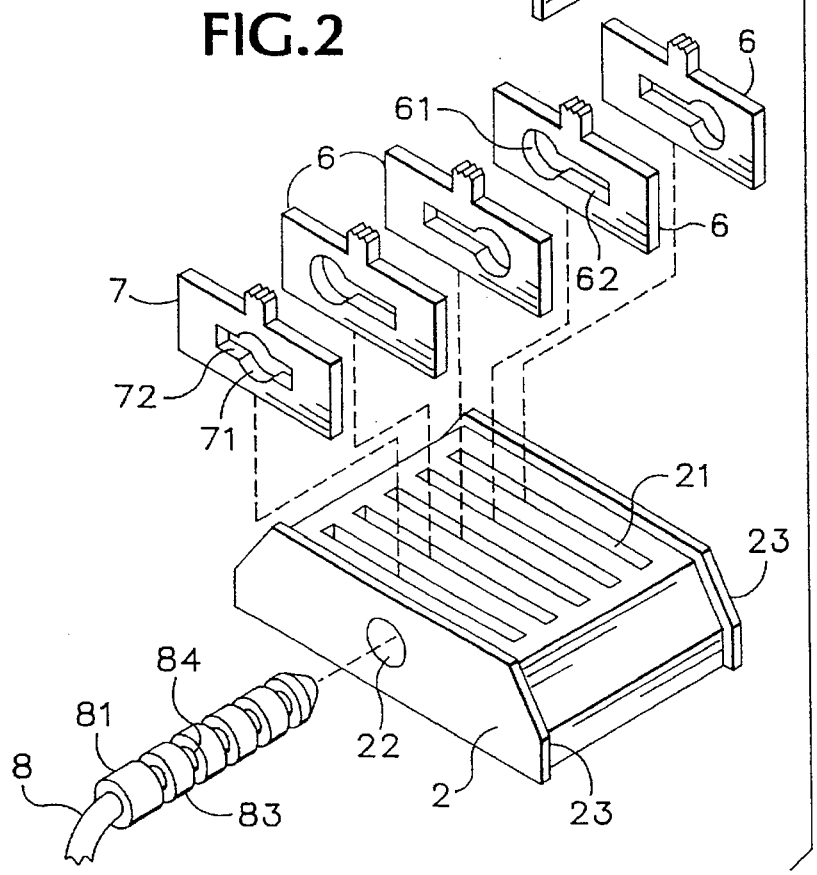
FIG. 2 is an exploded perspective view of the security anchor.
Figure 3:
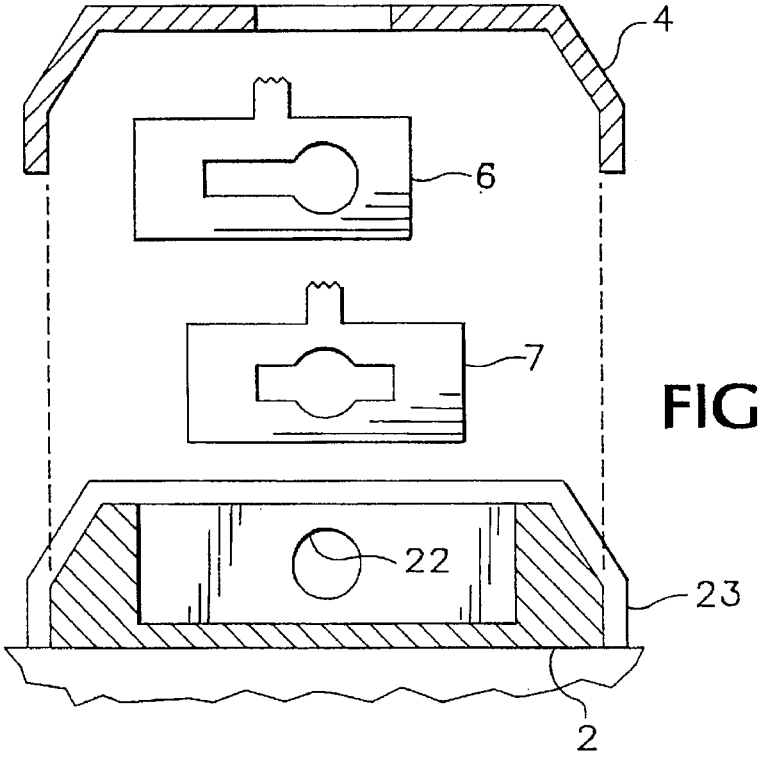
FIG. 3 is an exploded sectional view of the security anchor.
Figure 4:
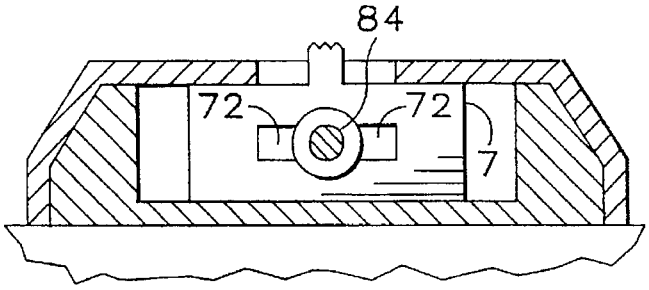
FIG. 4 is a sectional view of the security anchor showing a slider in releasing position.

The block 2 is made of synthetic polymer material and, in accordance with FIG. 1, has a bottom surface that is glued to a surface of a laptop computer 10 and also has a top surface. As shown in FIG. 2, there are five parallel channels 21 in the top of the block. A hole 22 enters the block at one end face of the block and extends in a direction approximately perpendicular to the length of the channels. The hole 22 is sized to receive the shaft 81 that is attached to one end of the flexible security cable 8. Lips 23 extend upward from the main body of the block at the two opposite ends thereof.

The security anchor further comprises a set of five sliders, consisting of four regular sliders 6 and one special slider 7, as shown in FIG. 2. The sliders also are made of synthetic polymer material. Each regular slider 6 is in the form of a rectangular plate with an asymmetrical keyhole opening consisting of a circular portion 61 and a rectangular slot 62 extending from the circular portion. The special slider 7 is also a rectangular plate of the same size and thickness as one of the sliders 6, but is formed with a symmetrical opening consisting of two rectangular slots 72 at opposite sides of a circular hole 71. Centered on the top of each slider is a knob 63.

Figure 5:
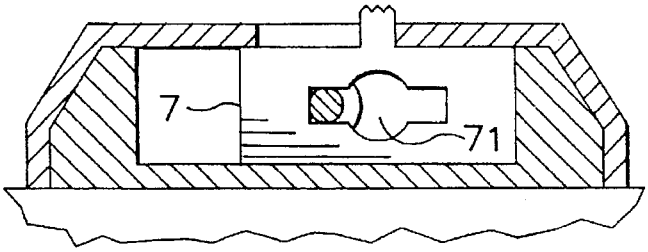
FIG. 5 is a similar view showing the slider of FIG. 4 in the locked position.
Figure 6:
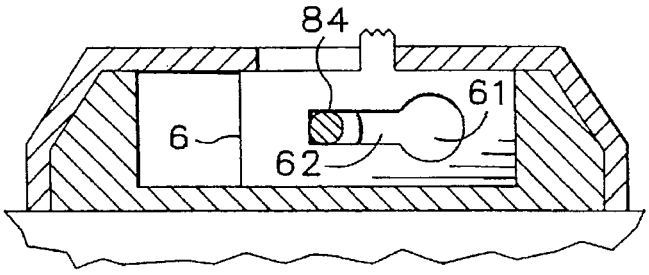
FIG. 6 is a sectional view of the security anchor showing an alternative slider in the locked position.

One of the sliders is installed in each channel 21. Each slider 6 or 7 can be positioned in its channel either in a releasing position in which the circular portion 61 or 71 is aligned with the hole 22 (FIG. 4) or in a blocking position in which the circular portion 61 or 71 is offset from the hole 22 (FIGS. 5 and 6). Referring to FIG. 2, the shaft 81 has wide portions 83 with a diameter that is slightly smaller than the diameter of the circular portions 61 of the sliders 6 or the circular portion 71 of the special slider 7, and narrow portions 84 with a diameter that is slightly smaller than the width of the rectangular slots 62 or 72 in the sliders 6 or 7. The narrow portions 84 are connected to the wide portions 83 by shoulders. When all of the sliders are in the releasing position, the shaft 81 can be inserted in or removed from the hole 22, whereas when any one of the sliders is in the blocking position, the shaft 81 cannot be non-destructively removed from the hole 22.

A locking combination is determined for the security anchor by selectively arranging the sliders in the respective channels. Each of the regular sliders 6 can be randomly inserted into a channel in the block with the rectangular portion of the keyhole slot facing to the left or with the rectangular portion of the keyhole slot facing to the right, as shown in FIG. 2. The special slider 7 can be inserted into the channel of the purchaser's choice. When a suitable arrangement is achieved, the cover plate 4 is placed over the main body of the block 2, between the lips 23, and is glued in place. The lips 23 resist insertion of a prying tool between the main body of the block 2 and the cover plate, and thereby resist removal of the cover plate from the block.

The cover plate 4 is made of synthetic polymer material and has five rectangular openings 41, corresponding to the five channels 21 in the block 2, which are shorter than the sliders 6 and 7. Thus, after the cover plate is glued on, the sliders 6 and 7 are retained in their respective channels. The knob 63 on the top of each slider 6 or 7 extends upward through the corresponding rectangular opening in the cover plate 4 to allow the position of the slider to be shifted in its channel 21. Numbers are engraved on the cover plate at each end of the five rectangular openings 41, and a center index mark is engraved on the top of the block and on the cover plate. The purchaser records the number that corresponds to the end of the rectangular opening where the knob of each regular slider rests when that slider is in its releasing position. The purchaser also notes which rectangular opening contains the special slider, which is in the releasing position when the knob is in the middle of its rectangular opening 41.

To secure a laptop computer, the cable 8 is secured to an anchor object, such as a chair leg, by passing the cable around the anchor object and threading the shaft 81 through the loop 82. The circular portion 61 of each regular slider and the circular portion 71 of the special slider are aligned with the hole 22 in the block 2, forming a bore, by adjusting the knobs 63 to their releasing positions by reference to the combination. The shaft 81 is inserted into the hole 22 and through the circular portions 61 and 71, and the sliders are jumbled so that at least one slider is in its blocking position. The shaft is thereby locked in the hole. The shaft is held securely until the sliders are adjusted, using the knobs 63, to realign the circular portions 61 and 71 with the hole 22, at which point the shaft is easily pulled from the hole 22.

Because movement of the sliders is limited by the ends of the rectangular openings, an unauthorized person cannot discriminate between a regular slider and the special slider on the basis of difference in travel of the different sliders, and cannot determine when a regular slider is in its releasing position on the basis of position of the slider.

It will be appreciated that the illustrated security anchor is simple and uncluttered. There is no key which could be misplaced. An advantage of the this security anchor is that unlike locking devices which utilize the disk drive or printer port, when this security anchor is installed, the computer is completely functional. The plastic block is small and unobtrusive and does not detract from the appearance of the computer. Also, there are no cumbersome cables permanently attached to the computer, because the single cable is completely removable when not in use. Security is also enhanced because the sliders are arranged by the purchaser into a unique combination.

It will be appreciated that the invention is not restricted to the particular embodiment that has been described, and that variations may be made therein without departing from the scope of the invention as defined in the appended claims and equivalents thereof.

I claim:

1. A security anchor for securing a portable article having a generally flat surface against theft, comprising:

a block for attachment to the article, the block having a first face that is substantially flat and is in confronting and contacting relationship with the generally flat surface of the article when the block is attached thereto and also having a second face and a third face, the block being formed with multiple slots that enter the block at the second face and are separated by webs of the block, and with a bore that enters the block at the third face and passes through the webs, a shaft that can be inserted in the bore, the shaft having a plurality of first length segments that alternate along the shaft with a plurality of second length segments such that when the shaft is in a fully inserted position in the bore, the first length segments are located in the slots respectively, the first length segments being of smaller cross-sectional area than the second length segments and being connected to the second length segments by shoulder portions of the shaft, a plurality of sliders fitted in the slots respectively and each of which can slide in a linear path only in its respective slot between a first position and a second position, each slider being formed with an aperture having a first portion that is sized to accept a first length segment of the shaft but is too small to receive a second length segment thereof and a second portion that is large enough to receive a second length segment of the shaft, the sliders can be brought to respective positions such that the shaft can be inserted into and removed from the bore and in other positions of the sliders the shaft cannot be non-destructively removed from the bore, and when the shaft is in the bore, the sliders are retained in their respective slots by virtue of the shaft extending through the respective apertures, a cover plate attached to the block at the second face thereof, the cover plate being formed with at least one opening through which the sliders are accessible, said opening being sized so that each slider is captive in its respective slot, and a flexible cable having first and second opposite ends, the shaft being attached to the cable at the first end thereof and the second end of the cable being provided with a means for attaching the cable to a mechanical ground.

2. A security anchor according to claim 1, wherein the cover plane is formed with a plurality of slot-form openings that are in registration with respective slots in the block.

3. A security anchor according to claim 2, wherein each slider includes a knob that projects through a respective slot-form opening in the cover plate, whereby the slider may be displaced in its slot in the block.

4. A security anchor according to claim 1, wherein the cable is formed with a loop at the second end thereof.

5. A security anchor according to claim 1, wherein each slider includes a knob that projects through said opening, whereby the slider may be displaced along its slot in the block.

6. A security anchor according to claim 1, wherein each slider has an adjustment element that is accessible through said opening for sliding the slider along its respective slot.

7. A security anchor according to claim 6, wherein at least one slider can be fitted in its slot in either a first orientation or a second orientation and the adjustment element of said one slider is accessible through said opening in each of the first and second orientations, and the adjustment element of said one slider has an appearance that is substantially the same regardless of whether said one slider is in the first orientation or the second orientation.

8. In combination, a portable article having a generally flat surface and a security anchor for securing the portable article against theft, said security anchor comprising:

a block having a generally flat first face and also having a second face and a third face, the block being formed with multiple slots that enter the block at the second face and are separated by webs of the block, and with a bore that enters the block at the third face and passes through the webs, the block being attached to the article with its generally flat first face in confronting relationship with the generally flat surface of the article, a shaft that can be inserted in the bore, the shaft having a plurality of first length segments that alternate along the shaft with a plurality of second length segments such that when the shaft is in a fully inserted position in the bore, the first length segments are located in the slots respectively, the first length segments being of smaller cross-sectional area than the second length segments and being connected to the second length segments by shoulder portions of the shaft, a plurality of sliders fitted in the slots respectively and each of which can slide in a linear path only in its respective slot between a first position and a second position, each slider being formed with an aperture having a first portion that is sized to accept a first length segment of the shaft but is too small to receive a second length segment thereof and a second portion that is large enough to receive a second length segment of the shaft, whereby the sliders can be brought to respective positions such that the shaft can be inserted into and removed from the bore and in other positions of the sliders the shaft cannot be non-destructively removed from the bore, and when the shaft is in the bore, the sliders are retained in their respective slots by virtue of the shaft extending through the respective apertures, a cover plate attached to the block at the second face thereof, the cover plate being formed with at least one opening through which the sliders are accessible, said opening being sized so that each slider is captive in its respective slot, and a flexible cable having first and second opposite ends, the shaft being attached to the cable at the first end thereof and the second end of the cable being provided with a means for attaching the cable to a mechanical ground.

9. A combination according to claim 8, wherein the block is attached to the article by an adhesive material between the generally flat surface of the article and the generally flat first face of the block.

10. A combination according to claim 8, wherein the cover plate is formed with a plurality of slot-form openings that are in registration with respective slots in the block.

11. A combination according to claim 8, wherein each slider includes a knob that projects through the opening in the cover plate, whereby the slider may be displaced in its slot in the block.

12. A combination according to claim 8, wherein slider has an adjustment element that is accessible through the opening in the cover plate for sliding the slider along its respective slot.

13. A combination according to claim 12, wherein at least one slider can be fitted in its slot in either a first orientation or a second orientation and the adjustment element of said one slider is accessible through the opening in the cover plate in each of the first and second orientations, and the adjustment element of said one slider has an appearance that is substantially the same regardless of whether said one slider is in the first orientation or the second orientation.

14. A combination according to claim 8, wherein the cable is formed with a loop at the second end thereof.

* * * * *